United States Patent [19]

Phillips

[11] 3,979,995

[45] Sept. 14, 1976

[54] SHELL CASING RESIZER

[76] Inventor: Welton E. Phillips, 1820 S. 11th Ave., Yuma, Ariz. 85364

[22] Filed: Feb. 21, 1975

[21] Appl. No.: 551,835

[52] U.S. Cl. ..... 86/36; 86/23
[51] Int. Cl.[2] ..... F42B 33/10
[58] Field of Search ..... 86/23–28, 86/36–38

[56] References Cited

UNITED STATES PATENTS

| | | | |
|---|---|---|---|
| 621,941 | 3/1899 | Parmenter | 86/23 |
| 2,680,988 | 6/1954 | Watson | 86/36 X |
| 2,825,259 | 3/1958 | Novak | 86/36 X |
| 3,345,903 | 10/1967 | Purdie | 86/24 X |

*Primary Examiner*—Edward A. Miller
*Attorney, Agent, or Firm*—Berman, Aisenberg & Platt

[57] ABSTRACT

A bench mounted, hand operated press used for resizing the brass on shot gun and small arms ammunition prior to reloading. The shell casing resizer comprises a lever-type press mechanism and two indexing resizing dies and features automatic shell ejection and automatic indexing. The shell ejection mechanisms are positioned within each of the resizing dies so as to effectuate ejection of a shell casing by exerting a force on the inner surface thereof. The two resizing dies are positioned in an end to end cooperating relationship with a lever-actuated ram such that while one shell casing is being pressed within one of the dies, another shell casing, already resized, is being ejected from the opposite die. The substantially simultaneous resizing and ejection actions are both the result of a single downward movement of the lever. The resizing die assembly is made rotatable at the junction of the two resizing dies and successively and alternatively rotates each resizing die to its resizing/ejection position in response to a single upward movement of the lever. Automatic indexing is achieved by means of a spring-loaded cam actuated alignment arm. Further, automatic ejection of the resized shell casings is facilitated by a spring-loaded secondary ejector assembly.

20 Claims, 13 Drawing Figures

SHELL CASING RESIZER

BACKGROUND OF THE INVENTION

1. Field of the Invention

This invention is related to machines utilized to resize the diameters of used shell casings and, more particularly, to a bench mountable and hand operable press utilized for resizing the brass body and rim on shot gun and small arms ammunition prior to the reloading thereof.

2. Description of the Prior Art

It is well known that conventional ammunition, such as shot gun shells, are physically capable of being reloaded and fired many times. It is necessary, however, after a shell has been fired either to replace the battery cup unit or replace the primer cap. Additionally, the firing of a shell generally deforms and otherwise distorts the walls and brass portions of the shell. Thus, in order to effectively reload a used shell for re-use, it is usually necessary to restore the wall of the shell to a smooth cylindrical contour and to flatten and straighten the brass base portion, which includes a cylindrical body and a substantially flat rim, both of which may have been deformed due to various stress encountered during the previous firing thereof.

Pertinent prior art U.S. Pat. Nos. of which I am aware include 621,941 to Parmenter, and 3,113,483 to Puth. The Parmenter device, for example, services only small arms ammunition and features a single resizing die A mounted on a swinging head 8 which allows the die to be rotated from under the ram for insertion and removal of the shell. The swinging head is not automatically indexed nor does it rotate the full 360°. Further, in the Parmenter device, the shell is manually removed from the resizing die by pulling on the rim thereof. As is common with such machines, if this rim shears off, as is apt to happen, the shell must be driven out by inserting a punch on the inside of the shell. Such an operation is, of course, both frustrating and time consuming and may lead to the destruction rather than the resizing of the shell.

The above-cited Puth reference teaches a device and method for resizing used shell casings which, however, is limited to shot gun shells. Further, the Puth device does not feature dual-automatic indexing dies nor automatic ejection of the resized shells as in the present invention which will become more clear hereinafter. Another disadvantage of the Puth device is that it fails in any manner whatsoever to provide any means for resizing or otherwise controlling the outer diameter of the shell rim. This is important inasmuch as the outer diameter of the brass rim of a shell has a tendency to increase if not restrained or controlled which can cause the brass body to separate from the paper or plastic portion of the shell. Further, if uncontrolled, the rim diameter of the shell may expand to a point where the shell will not fit in the magazine of its associated shot gun.

I have also encountered several problems with commercially available shell casing resizers. One such problem is the lack of power or leverage available to both resize and extract the shell casings. In existing resizers, for example, the ram or die must travel the full length of the shell such that the shell may be inserted under the die and removed after resizing. One of the objects of the present invention is to provide more leverage into the lever-press mechanism by reducing the required travel of the ram. Further, on existing resizers, the shell is generally removed from the die on the upward stroke of the press handle. This reduces the amount of power available for the extraction of the shell, particularly if the machine is not mounted on a heavy foundation. Thus, another object of the present invention is to provide a shell casing resizer in which both the resizing and extraction operations are performed in the downward stroke of the press handle-lever.

A still further problem encountered with prior art resizing machines involved frequent difficulties encountered in extracting the shell from the resizing die. One particular prior art resizer includes an extracting and depriming plunger having a particularly tapered tip at the point of contact with the inside of the shell. Unfortunately, as force is increased on such a plunger, it tends to wedge into the primer hole thereby expanding the base of the shell which tends to increase the resistance to the extraction operation. Without such a taper, however, it would be rather difficult to initially get the plunger past the crimp end of the shell when inserting for resizing. Thus, a still further object of the present invention is to overcome such problems by the inclusion of an automatic ejection feature, as will become more clear hereinafter.

Another area of concern with respect to existing machines and methods involves the present tendency of operators of such machines to inadvertently, perhaps by means of inattention, fail to completely resize the shell by, for example, failing to complete the lever stroke. Thus, a still further object of the present invention is to obviate such operator error by requiring a full resizing stroke prior to the time the next operation may be initiated.

A further undesirable feature generally characteristic of presently commercially available resizers is their inherent lack of speed. Accordingly, an additional object of the present invention is to provide a shell casing resizer which features increased speed of the resizing, as well as the extraction, operations.

Thus, a further generalized object of the present invention is to provide a shell casing resizing machine which is more versatile, reliable, and produces a better quality shell than available from the prior art models.

A still additional object of the present invention is to provide a machine for resizing used shell casings which features a pair of cooperating resizing dies which incorporate automatic shell ejection and automatic indexing.

Another object of the present invention is to provide a shell casing resizer which effectively reshapes the outer diameter of the brass body portion of shell casings, the rim portions of the shell casings, and further includes means for reshaping the rim portions of the shell casings.

A still further object of the present invention is to provide a shell casing resizing machine which may be easily adapted to resize either shot gun shells or small arm ammunition shells.

A still further object of the present invention is to provide a shell casing resizer in which both the resizing and ejection operations occur in response to the same force transmitted during a single downward stroke of the cooperating press lever-handle.

An additional object of this invention is to provide a shell casing resizing machine which, by virtue of automatic indexing and automatic ejecting features, requires less force than previous machines to accomplish better results in far less time.

A still further object to the present invention is to provide a shell casing resizer which incorporates a depriming plunger for automatically depriming the associated shell during its resizing cycle.

SUMMARY OF THE INVENTION

The foregoing and other objects are obtained in accordance with one aspect of the present invention through the provision of a machine for resizing used shell casings which comprises a pair of oppositely disposed dies upon each of which is manually mounted, in turn, a used shell casing. The machine further includes a manually operable press for applying force to one of the shell casings to urge the same past its associated die during a downward resizing-ejection stroke. Means further responsive to the same force are provided for automatically ejecting the other of the shell casings from the other die, said other shell casing having already been resized. Each of the dies comprises a tubular member having a resizing bore defined by an inwardly extending annular shoulder near the open end thereof. The other ends of the pair of tubular members are joined so as to define a common longitudinal axis. The joined tubular members are adapted to be rotatable about the midpoint junction thereof to alternately place one, then the other, die adjacent a lever-operated ram. A pair of similar ejection assemblies are positioned one each within a respective tubular member. Each of the automatic ejection assemblies comprises a primary ejector operable by the force exerted on the opposing ejector by the ram during the resizing operation, and a secondary spring-loaded ejector concentrically positioned within the primary ejector. The spring-loaded ejector assumes the responsibility for final ejection of the resized shell casing after the brass body portion thereof has been freed from the annular resizing rim of the die. The resizer further features automatic indexing means for alternatively and successively positioning each of said dies adjacent the lever-operated ram head. The automatic indexing means comprises means for rotating the tubular members about the midpoint junction thereof during the upward indexing stroke of the lever-handle. A spring-loaded alignment arm and indexing cam mounted about the pivotal axis of the tubular members assists in the indexing operation and the automation thereof.

BRIEF DESCRIPTION OF THE DRAWINGS

Other objects, features and attendant advantages of the present invention will be more fully appreciated as the same becomes better understood from the following detailed description of the present invention when considered in connection with the accompanying drawings, in which.

DETAILED DESCRIPTION OF A PREFERRED EMBODIMENT

Figure 1:
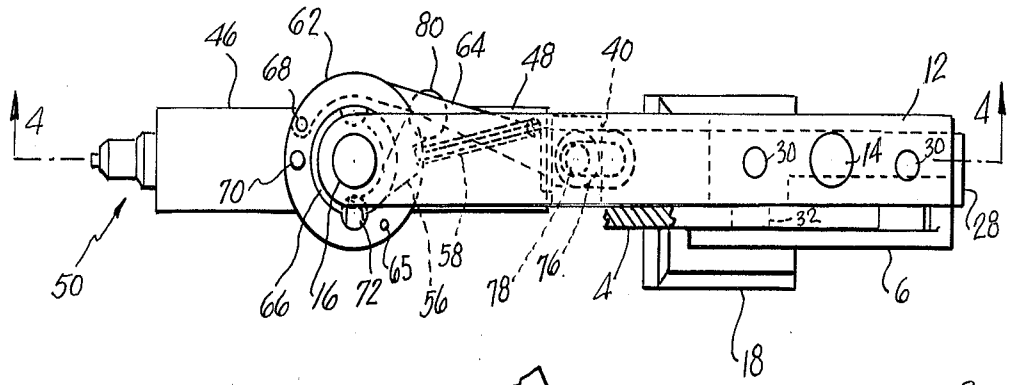
FIGS. 1–3 are respectively top, side, and frontal plan views of a shell casing resizing machine according to a preferred embodiment of the present invention.
Figure 2:
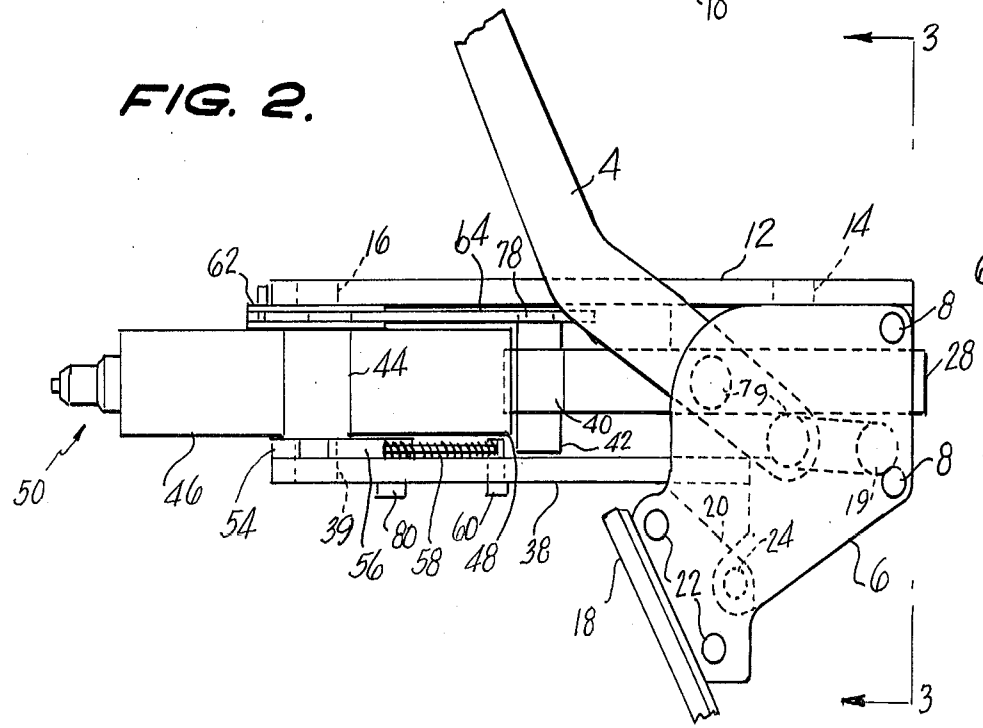
Figure 3:
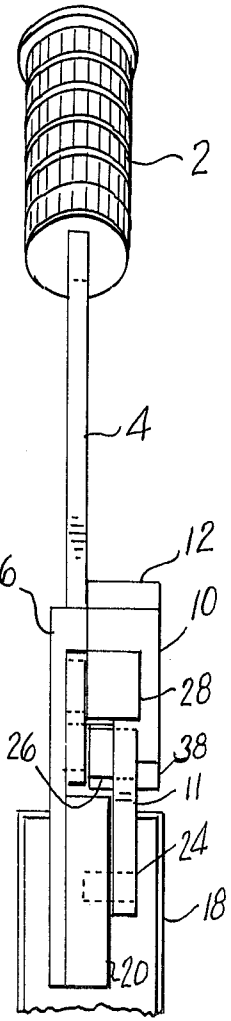

Referring now to the drawings, wherein like reference numerals designate identical or corresponding parts throughout the several views, and more particularly to FIGS. 1–4 thereof, a preferred embodiment of the shell casing resizing machine according to the present invention is therein illustrated in top, side, frontal and sectional views, respectively.

The machine includes a manually operable press-type mechanism which essentially comprises a lever 4 one end of which terminates in a hand grip 2. The other end of lever 4 extends through a slot formed by a main frame 10 onto which a cover plate 6 is secured by means of retaining screws 8. At the lower portion thereof, lever 4 has formed therein a pair of pin-receiving apertures 7 and 9.

The machine further includes an upper support arm 12 which is mounted by means of screws 30 to main frame 10. Upper support arm 12 includes a rear aperture 14 which is non-pivotally fitted with a positioning pin 88 formed integral with main frame 10. Upper support arm 12 further includes a forward aperture 16 which pivotally receives a pin 90 integrally formed as part of an indexing head 44.

The machine, by way of example, may be provided with a mounting plate 18 upon which may be screw-mounted a mounting base 20. Cover plate 6 is secured to mounting base 20 by means of screws 22, while a lower planar part 11 of main frame 10 is secured to base 20 by means of screw 24.

A lower support arm 38 is screw-mounted at the rear portion thereof, as at 92, to the underside of main frame 10. The forward portion of lower support arm 38 is provided with an aperture 39 for receiving the lower pin 52 integrally formed in indexing head 44. The lower support arm 38 further includes a third aperture 98 formed at the midportion thereof through which pass the deprimed primers after ejection. Finally, lower support arm 38 includes an aperture through which an alignment arm pivot pin 80 passes, the purposes of which will become more clear hereinafter.

A linkage 26 has a pair of pins 34 and 36 protruding on opposite sides and ends thereof into cooperating apertures 9 and 19 formed respectively in lever 4 and the lower portion 11 of main frame 10. The other aperture 7 of lever 4 rotatably receives a pin 32 formed on the side of a ram member 28. Ram member 28 moves in lateral reciprocating motion in response to the movement of lever 4 and its pivotal cooperation with respect to pivots 32, 34 and 36. In FIGS. 1–4, lever 4 and ram 28 are shown in a first, fully downwardly extended position.

Figure 4:
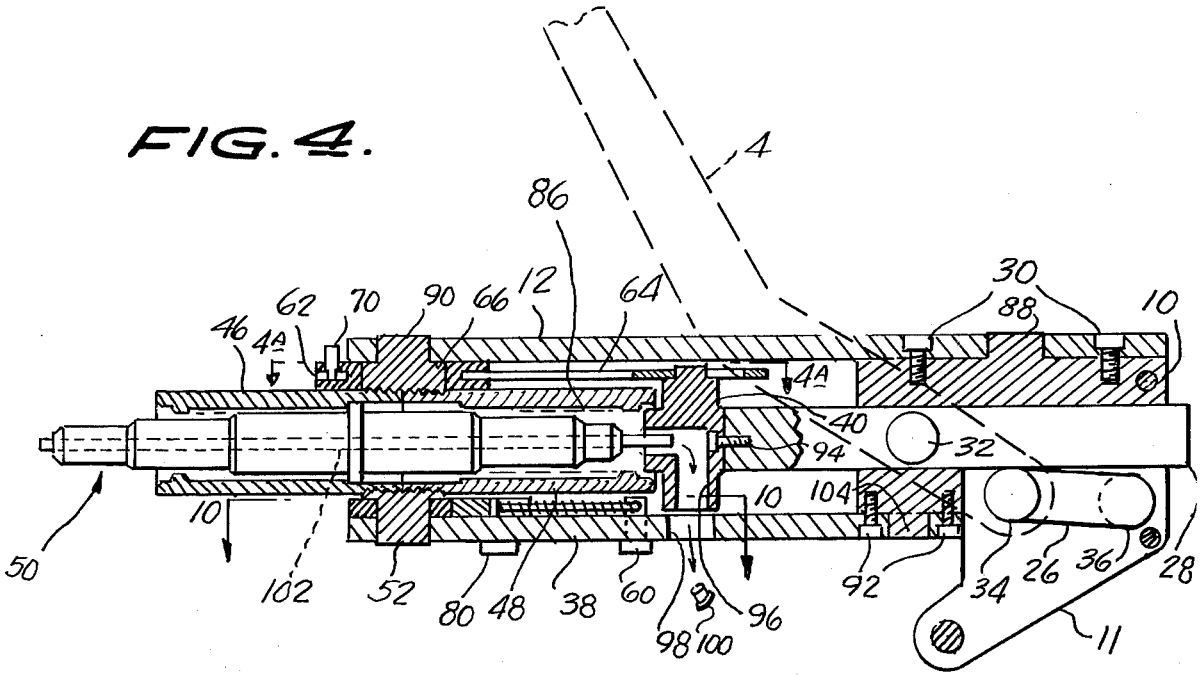
FIG. 4 is a sectional view of the preferred embodiment of the resizing machine shown in FIG. 1 and taken along line 4—4 thereof.

To the inner end of ram member 28 is screw mounted, as at 94, a ram head 40, the forward end of which is adapted to contact the shell casing to be resized. A lower extension 42 of ram head 40 serves as a guide along lower support arm 38. Ram head 40 also includes an upper index-actuating pin 78 positioned to move within a longitudinal slot 76 which is formed in one end of a reciprocating arm 64, the purpose of which will become more clear hereinafter. Further, as best seen in FIG. 4, ram head 40 includes an integrally formed L-shaped bore 96 for passing the deprimed primers 100 therethrough. The lower portion of bore 96 is in alignment with aperture 98 formed in lower support arm 38.

Screw mounted in opposed longitudinal relationship to indexing head 44 are a pair of resizing dies and ejector housings 46 and 48. Within die-housing 46 is a first shell ejector assembly indicated generally by the reference numeral 50. Like ends of resizing die-housings 46 and 48 are threadably mounted within indexing head 44, as perhaps best shown in FIG. 4. Included within respective housings 46 and 48 are a pair of substantially identical shell ejector assemblies, one of which is indicated generally at 50, the operation and structure of which will be described in more detail hereinafter.

Indexing head 44 includes a lower pin 52 pivotally coupled through an aperture in an indexing cam 54 and aperture 39 in lower support arm 38, as described above.

The structure of the automatic indexing assembly according to the present invention includes an indexing cam 54 which is tightly screw-fitted to the underside of head 44 in order rotate therewith. A die alignment arm 56 is pivotally mounted to lower support arm 38 by means of pin 80. A spring-rod assembly, indicated generally in FIGS. 1–4 by the reference numeral 58, cooperates with arm 56 to provide the automatic indexing feature of the present invention. One end of the rod of spring-rod assembly 58 is inserted into an aperture in die alignment arm 56, the other end of which is inserted into an aperture in a pin 60 mounted in lower support arm 38 (see FIGS. 10 and 11).

Just below upper pivot pin 90 of indexing head 44 and integrally formed with the latter is an indexing pivot pin 66 having a larger diameter than that of pivot pin 90 below which it is disposed. An indexing ring 62 having upper and lower plates is ratchet engaged over indexing pivot pin 66 of head 44. A hook-shaped reciprocating arm 64 is pivotally mounted at 68 between the upper and lower plates of indexing ring 62. The other end of reciprocating arm 64, as explained above, terminates in a longitudinal slot 76 which cooperates with the index actuating pin 78 of ram head 40.

Figure 4A:
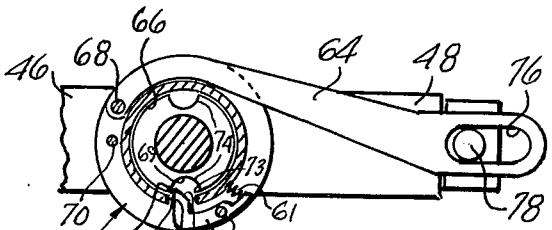
FIGS. 4*a* and 4*b* are respectively top and side views of the details of reciprocating arm and indexing ring assembly according to the present invention which are helpful in understanding the operation thereof.
Figure 4B:
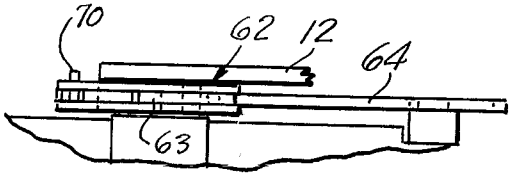
Figure 10:
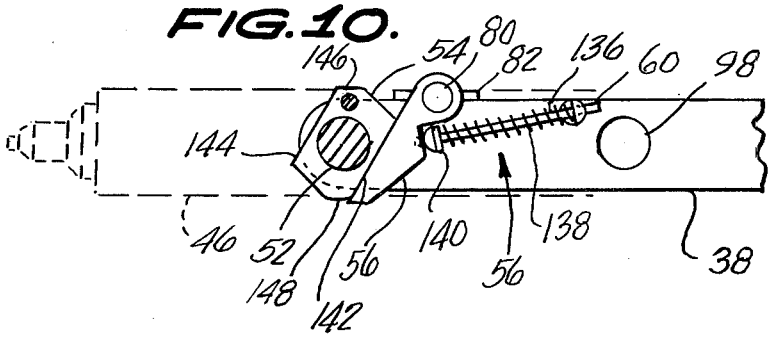
FIG. 10 is a top view of the automatic indexing cam apparatus taken along line 10—10 of FIG. 4.
Figure 11:
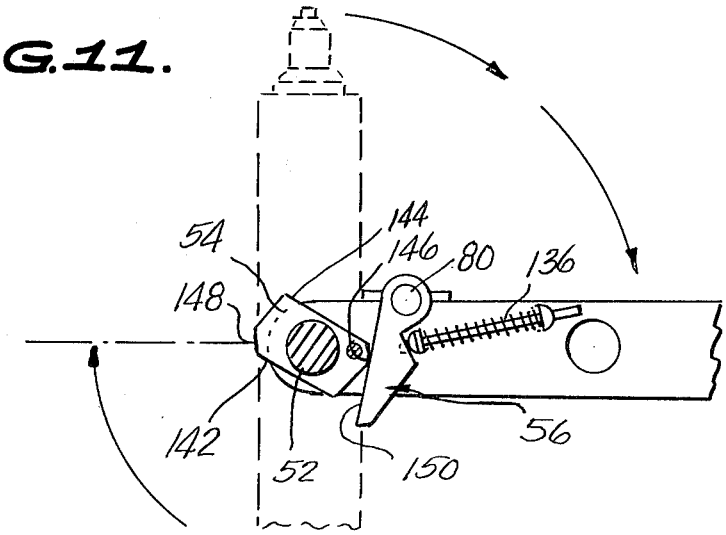
FIG. 11 is another illustration of the apparatus shown in FIG. 10 during a rotational movement thereof.

Extending from the upper plate of indexing ring 62 is a stop pin 70. As best seen in FIGS. 4*a* and 4*b*, the lower plate of ring 62 includes a notch 72 formed on the inner circumference thereof. Indexing pin 66 likewise has a pair of notches 74 disposed 180° apart on its outer circumference. A pawl 63 is pivotally fastened to indexing ring 62 by a pin 65. Pawl 63 includes a pointed head 67 which is normally urged radially inwardly by means of a spring 61. As viewed in FIG. 4*a*, head coincides with one of the notches 74 in pin 66 so as to be engaged therewith. By virtue of the 180° placement of notches 74 on pin 66, such engagement occurs upon the completion of each of the resizing-ejection strokes of lever 4, the latter to be explained in more detail hereinafter. During the alternate indexing stroke of lever 4, the indexing ring 62 is caused to rotate in a clockwise direction as viewed in FIG. 4*a* to bring edge 75 of pawl 63 in contact with surface 69 of lower notch 74. Thereafter, ring 62 and pin 66 rotate clockwise in unison until the spring-loaded automatic indexing assist structure, to be described below in connection with FIGS. 10 and 11, is activated. At that time, surface 73 of notch 74 will contact the inclined surface 71 of pawl 63 to pivot the latter about pin 65 out of engagement with notch 74. As explained below, after such disengagement, indexing pin 66 will continue its clockwise rotation without further assistance from indexing ring 62.

Referring now to FIG. 10, there is shown the detail of the spring-loaded automatic indexing assist structure of the present invention. Indexing cam 54 is shown in position as being rotatable about the lower pin 52 of indexing head 44 which extends further therebelow through lower support arm 38. Shown in dotted outline is a first resizing die and ejector housing 46 in a ready-to-be-loaded position. Indexing cam 54 has a plurality of cam surfaces 142, 144, 146 and 148, surfaces 142 and 144 defining stationary rest positions. while surfaces 146 and 148 define intermediate indexing positions. Die alignment arm 56 includes a cam surface 150 (FIG. 11) which is illustrated in FIG. 10 in stationary abutment with surface 142 of indexing cam 54. Die alignment arm 56 is seen to be rotatable about pivot pin 80 which is rotatably secured to lower support arm 38 by means of retain cap 82 which itself may be screw-mounted into the side of lower arm 38.

Spring-rod assembly 58 is seen to consist of a rod 138 having a stop 140 against which one end of spring 136 abuts. The other end of spring 136 abuts a stop surface of pin 60. One end of rod 138 fits into and is slidably movable in an aperture within pin 60, the other end thereof fitting into a similarly sized aperture in alignment arm 56 against which pressure is maintained under the force of spring 136. As previously mentioned, indexing cam 54 is secured to the lower surface of indexing head 44 so as to be at all time rotatable therewith.

Figure 5:
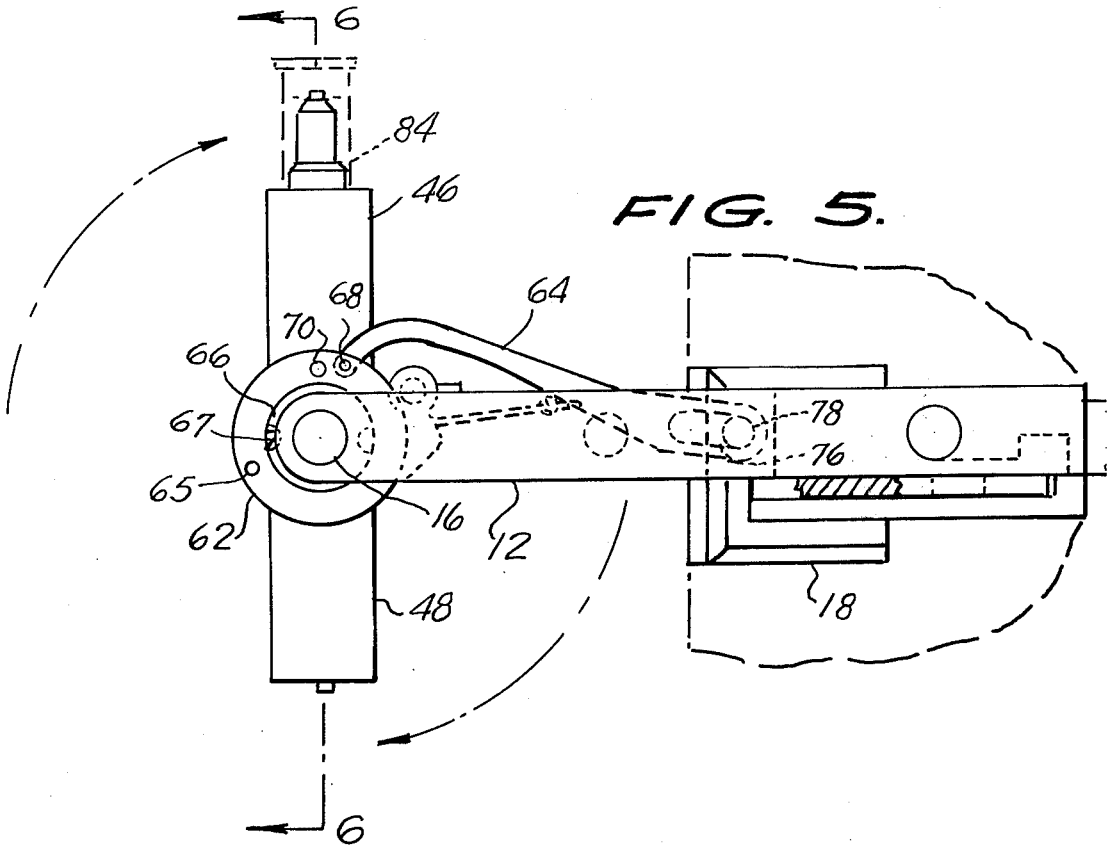
FIG. 5 is a top view of the preferred embodiment seen in FIGS. 1–4 but during a rotational indexing operation thereof.
Figure 6:
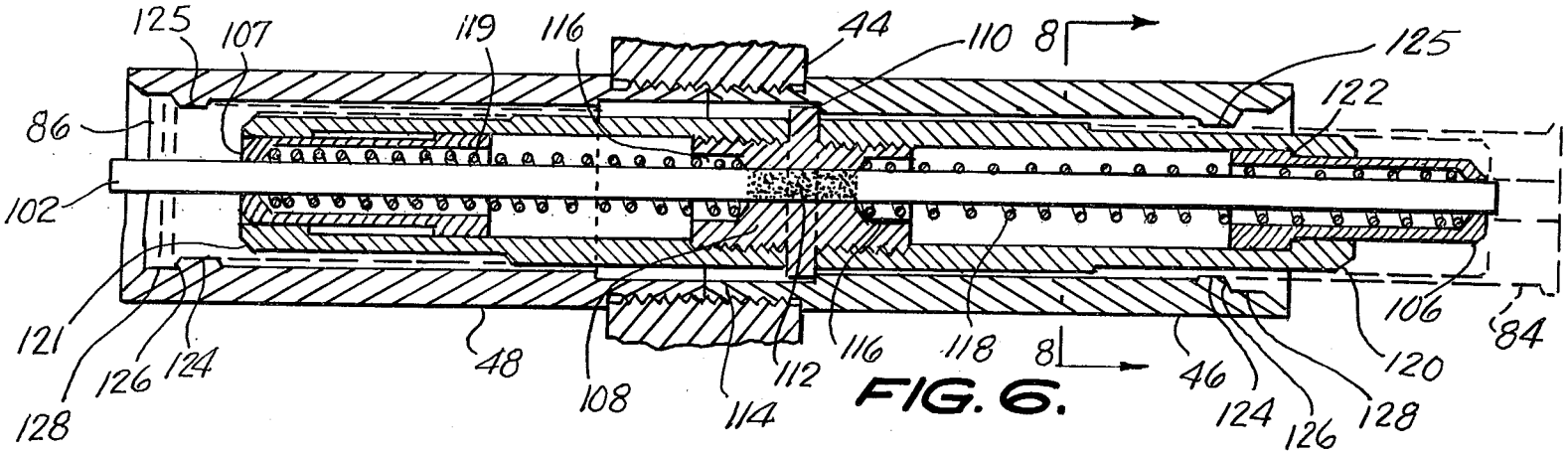
FIG. 6 is a sectional view taken along line 6—6 of FIG. 5 and particularly illustrating the details of the automatic ejector assemblies of the present invention.
Figure 8:
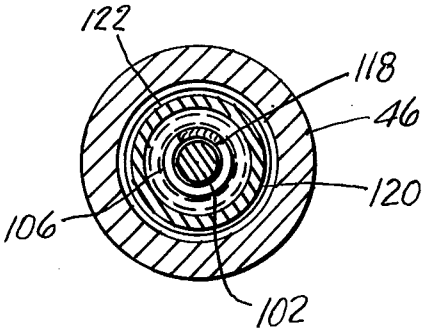
FIG. 8 is a cross-sectional view taken along line 8—8 of FIG. 6.
Figure 7:
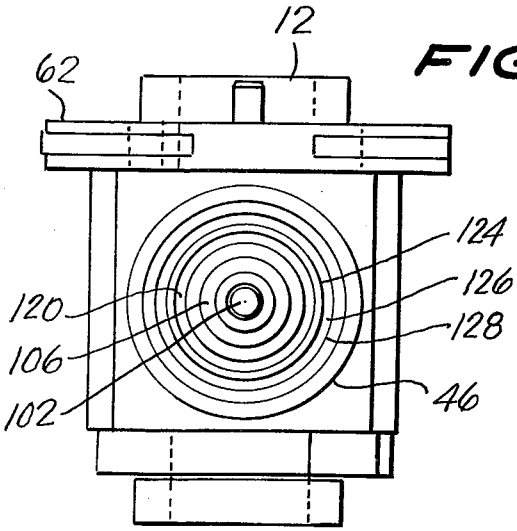
FIG. 7 is an end view of the apparatus depicted in FIG. 6.

FIGS. 6–8 illustrate the structure of the dual automatic ejection assembly in accordance with the present invention. FIG. 6 is illustrative of such ejection assemblies in an intermediate static state, FIG. 6 being a sectional view taken along line 6—6 of FIG. 5. In FIG. 6, shown in dotted outline within one resizing die 46 is an un-resized shell 84, while a resized shell 86 is shown in phantom outline mounted within die-ejector assembly 48. Each ejector assembly includes a primary ejector 120 and 121 which are threadingly coupled via an ejector slide member 108. Slide and coupling member 108 has a flange 110 peripherally formed thereabout. Flange 110 is free to move axially within a recess 114 which is formed by the junction of primary ejectors 120 and 121 and dies 46 and 48.

A deprimer rod 102 extends through the assemblies and is firmly secured to slide member 108 by, for example, solder 112. Recesses 116 are formed axially on both ends of slide 108 for receiving a pair of springs 118 and 119. Springs 118 and 119 are disposed about deprimer rod 102, and extend to the inner cylindrical surfaces of respective secondary ejector assemblies 106 and 107 which are in the form of tubular members. A flange 122 formed on ejector 106 cooperates with a similar inwardly extending lip on primary ejector 120 to act as a stop to hold secondary ejector 106 within the assembly.

Die housing 46 is seen to include an inwardly extending annular shoulder 125 which defines a plurality of resizing and reshaping surfaces. Such surfaces include a shell body diameter resizing lip 124, a shell rim reshaping surface 126, and a shell rim diameter resizing lip 128. It is noted that die 48 is constructed similarly.

It should also be noted that flange 110 of slide member 108 is free to move axially within the confines defined by recess 114. The motion of flange 110 is in response to the movement of primary ejectors 120 and 121, the outer surfaces of which will be force-receiving surfaces adjacent the rim portion of the shell to be resized, such as shell 84. In FIG. 6, shell 86 is assumed to have just been resized by being force past annular shoulder 125.

Figure 9:
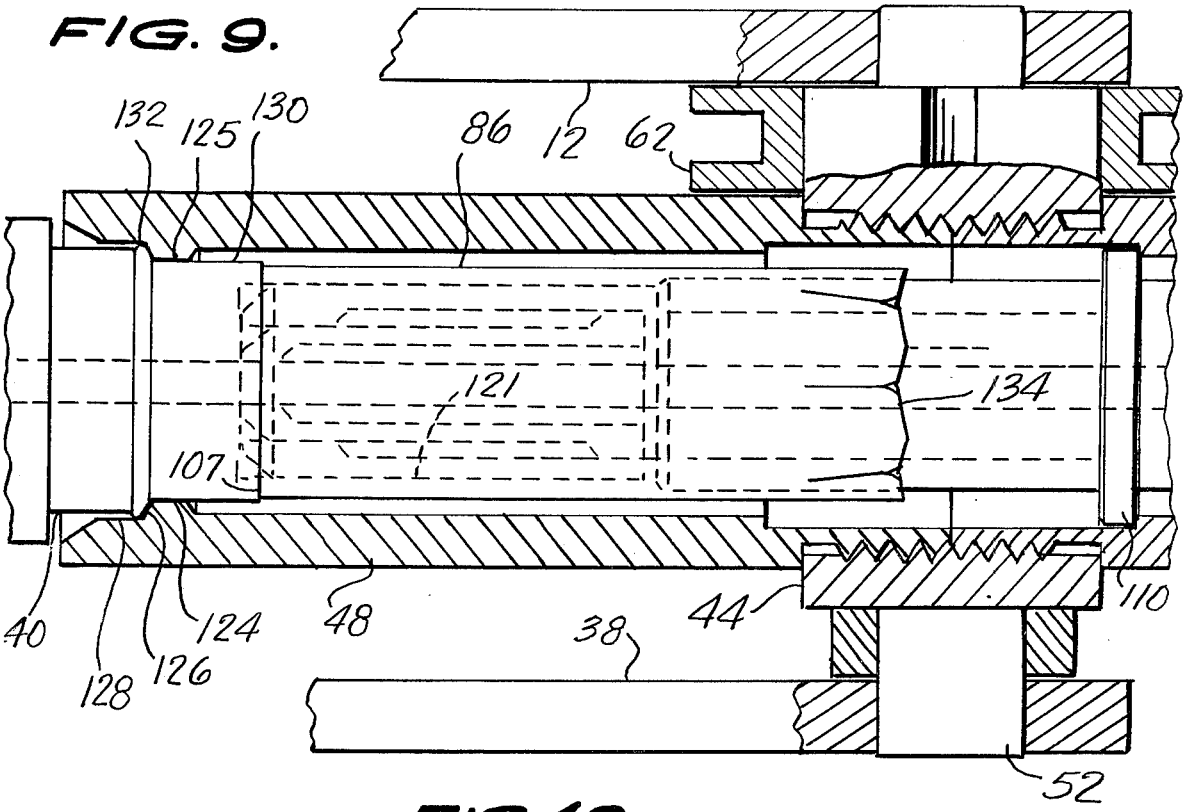
FIG. 9 is an enlarged, partially sectional view showing one of the dies operating on an associated shell casing in accordance with the present invention.

This is more clearly seen in FIG. 9 which illustrates certain parts of the apparatus just subsequent to the resizing-ejection stroke of lever 4. Shell 86 is seen to comprise a brass body portion 130, a brass rim portion 132, and a decrimped paper end 134. Ram head 40 is shown in direct abutment with brass rim 132 of shell 86, whereas annular shoulder 125 is shown firmly engaging brass body 130 thereof. Shell 86 has just been forced through the die 48, resizing lip 124 serving to reform the body diameter of shell 86, reshaping surface 126 serving to reshape the rim 132 where it abuts body 130, and resizing lip 128 serving to resize the diameter of shell rim 132. Thus, in FIG. 9, shell 86 is held in position by virtue of the engagement of annular shoulder 125 with body 130. This force is sufficient to maintain shell 86 within housing 48 despite the outwardly urging force of compressed spring 119 of associated secondary ejector assembly 107. Notice that in this position, flange 110 of slide member 108 abuts the right most portion, as seen in FIG. 9 of recess 114. Also note that the present invention provides means for not only resizing the diameter of the body portion of the shell casing, but further provides means for reshaping and resizing the rim portion of the shell casing, if needed.

The operation of the shell casing resizing machine with dual automatic indexing and automatic ejection will now be described principally in conjunction with FIGS. 4, 5, 10, and 11. It should first be noted that lever 4 basically has two operational strokes, i.e., an indexing stroke and a resizing-ejection stroke. FIG. 4 illustrates the position of lever 4 and the condition of the associated components just subsequent to the completion of the resizing-ejection stroke and just prior to the initiation of the indexing stroke thereof. In FIG. 4, it may be assumed that a shell has just been ejected from ejector assembly 50, and that ram head 40 has just finished forcing shell 86 through die assembly 48 so as to resize the body and rim diameters thereof, as explained above in conjunction with FIG. 9. Further, deprimer rod 102 has just ejected the primer 100 from the head of shell 86, the primer having been allowed to escape via bore 96 and aperture 98, as aforedescribed.

Further, the position of reciprocating arm 64 relative to indexing rim 62 is essentially as shown in FIG. 1, actuating pin 78 being positioned adjacent the forward portion of longitudinal slot 76 at the completion of the resizing-ejection stroke of lever 4.

FIG. 10 is illustrative of the relative position of indexing cam 54 and die alignment arm 56 subsequent to the completion of the resizing-ejection stroke of lever 4, cam surface 150 abutting stationary edge 142.

At this point, the operator of the machine places the open end of a used shell casing 84 onto the previously empty shell ejector assembly 50. The un-resized shell casing 84 is maintained in position by virtue of the holding force exerted by annular rim 125 of die 46 and outer surface of primary ejector 120 and is generally inserted within die 46 an amount equal approximately to one third of its total length. The operator of the machine proceeds to index shell 84 into proper positioning for resizing by moving lever 4 upwardly (to the right as viewed in FIG. 4).

FIG. 5 illustrates a midpoint during the indexing stroke of the device of the present invention. It is seen firstly that upper index actuating pin 78, being an extension of ram head 40, moves to the right due to the reciprocating movement of ram 28. Pin 78 engages the right most portion of longitudinal slot 76 so as to move arm 64 to the right. Arm 64 by virtue of its pivoted connection at 68 to ring 62 moves the latter in a rotational motion about an axis defined by pivot pin 66. As explained hereinable, the ratchet action between the indexing ring and the pivot pin 66 ensures that the latter rotates along with the former during this stroke. Naturally, since indexing pin 66 forms an integral part of indexing head 44, dies 46 and 48 rotate therewith as shown.

Referring now to FIG. 11, there is illustrated the relative position of the automatic indexing assembly which corresponds to the position of the parts shown in FIG. 5. It is seen that by virtue of the rotation of indexing head 44 to which it is attached, indexing cam 54 has rotated relative to the cam surface 150 of die alignment arm 56. This rotational movement has brought cam surface 146 into contact with the cam surface 150 of die alignment arm 56 so as to compress spring 136. It should be apparent that a slight further rotation of indexing head 44, and hence indexing cam 54, from the position shown in FIG. 11 will cause die alignment arm 56 by virtue of spring 136 to continue the rotational movement thereof until stationary edge 144 firmly abuts camming surface 150 of arm 56. In the foregoing manner, the final rotational indexing movement initated by the operation of lever 4 is smoothly and automatically completed to a position which further ensures alignment of unresized shell 84 with ram head 40. It should further be apparent that surfaces 148 and 142 of indexing cam 54 cooperate to perform the same function during the next indexing stroke of lever 4.

Thus, subsequent to the operation described above with respect to the automatic indexing operation, unresized shell casing 84 will be in position for resizing, lever 4 having been moved through its indexing stroke to be positioned at its right most position with respect to the view shown in FIG. 4. The status of the ejection elements in this state may be seen in FIG. 6, wherein the unresized shell 84 is shown just prior to the application of force thereto, and resized shell 86 is shown firmly held within die 48 by virtue of annular ring 125 just prior to the ejection thereof. When the ram head is applied to shell 84 to force the same within resizing die 46, slide member 108 will be moved to the left as viewed in FIG. 6. This will generally occur only when the inside surface of the rim of shell 84 abuts the primary ejector 120. Further movement of the ram head 40 against the rim of shell 84 will then cause movement to the left of primary ejector 120, slide member 108, and hence primary ejector 121. When the brass body portion of shell 86 has cleared annular shoulder 125 of die 48, spring 119 will no longer be restrained so as to exert an outwardly extending force upon secondary ejector 107. Secondary ejector 107 will, complete the automatic ejection operation of shell 86 therefrom by exerting a sufficient force on the inside portion thereof. After shell 86 has been ejected, the machine will return to its initial position as viewed in FIG. 4.

It should be noted at this point that during the resizing-ejection stroke of lever 4, during which time ram 28 moves from its right most to its left most position as viewed in FIG. 4, arm 64 is also urged to the left by virtue of the abutment of actuating pin 78 with the inner slot 76. This, in turn, causes ring 62 to re-rotate in a direction opposite to that which it rotated in the indexing stroke, in order to resume its initial position as shown in FIG. 1.

It is seen by virtue of the foregoing that I have provided a shell casing resizer which features dual automatic indexing resizing dies and automatic ejection. The body portion of the shell casings, as well as the rims, are resized and reshaped in accordance with the present invention. Further, the invention is easily adaptable to resize either shot gun or small arms ammunition. Conversion of the machine to handle different sized shell casings involves only changing the size of the dies, ram head, and ejector mechanism. The present invention further enables more power to be placed into both the resizing and extraction operations due to the indexing feature. That is, with respect to a 2¾ inch shot gun shell, the ram needs to travel only 1¾ inches since the shell has already been inserted over 1 inch into the die when the shell is indexed into position for resizing. This has allowed more leverage to be designed into the press mechanism. Further, in the machine according to the present invention, both the resizing and extraction operations are performed in the downward stroke and are timed so as to provide minimum overlap. Thus, full power is available for each operation. Moreover, the automatic ejection feature of the present invention first provides an excellent guide for inserting the crimp end of the shell prior to resizing and secondly conforms to the inside profile of the shell to provide a clean and accurate ejection operation. Moreover, the present invention tends to reduce operator error in that the dies may not be automatically indexed until the resizing operation has been satisfactorily completed, i.e., a full resizing-ejection stroke has been accomplished. Finally, the machine according to the present invention provides far greater speed and thus economy when compared with prior art resizers.

I wish it to be understood that I do not desire to be limited to the exact details of construction shown and described for obvious modifications will occur to a person of ordinary skill in the art.

I claim as my invention:

1. A machine for resizing used shell casings, which comprises:

a pair of oppositely disposed die means each of which receives a shell casing for resizing same;

manually operable press means for applying force to one of said shell casings to urge same past its associated die means; and means further responsive to said force for automatically ejecting the other of said shell casings from the other of said die means.

2. The machine as set forth in claim 1 wherein each of said pair of die means comprises a tubular member having a resizing bore defined by an inwardly extending annular shoulder formed near an open end thereof.

3. The machine as set forth in claim 2, wherein the other ends of said pair of tubular members are joined to one another so as to define an inner annular recess and such that their respective longitudinal axes are coincident.

4. The machine as set forth in claim 3 wherein said automatic ejecting means comprises a pair of approximately identical ejection assemblies each normally positioned within a respective one of said tubular members.

5. The machine as set forth in claim 4 wherein said automatic ejecting means further comprises means for coupling said pair of ejection assemblies at like ends thereof, said coupling means being restrained in movement within the limits defined by said recess.

6. The machine as set forth in claim 5 wherein each of said ejection assemblies comprises primary ejector means over which said shell casing is placed by said press means, said primary ejector means for initially ejecting its associated shell casing in response to said force applied to the other of said shell casings.

7. The machine as set forth in claim 6, wherein each of said ejection assemblies further comprises secondary spring-loaded ejector means disposed within said primary ejector means for finally ejecting said associated shell casing from its respective die means.

8. The machine as set forth in claim 7 wherein said ejection means further comprises means longitudinally positioned throughout said ejector assemblies and rigidly affixed to said coupling means for depriming said shell casings upon the application of said force.

9. The machine as set forth in claim 8 wherein each of said ejection assemblies further comprises a spring positioned about said depriming means and between said coupling means and said secondary ejection means for urging the latter outwardly against the inner surface of its associated shell casing.

10. The machine as set forth in claim 3, further comprising automatic indexing means for successively and alternatively positioning said open end of each of said die means adjacent said press means.

11. The machine as set forth in claim 10, wherein said automatic indexing means comprises an indexing head fixedly secured to the junction of said other ends of said tubular members, and means for releasably grasping said indexing head for rotating same about a rotational axis which is perpendicular to said longitudinal axis of said tubular members.

12. The machine as set forth in claim 11, wherein said means for applying force to one of said shell casings comprises a hand-operated lever movable between first and second positions, and ram means for reciprocating in response to the movement of said lever, said ram means including a head for directly pressing against said one of said shell casing while said lever is being moved from said second position to said first position.

13. The machine as set forth in claim 12, wherein said indexing head includes a pivot pin formed thereon and wherein said means for releasably grasping said indexing head comprises a ring member ratchetly engaged about said pivot pin, and a reciprocating arm linking said ring member to said ram means for causing said ring member to rotate in response to the reciprocating movement thereof.

14. The machine as set forth in claim 13 wherein said releasably grasping means further comprises means for causing said pivot pin to be rotated with said ring member while said handle is moved from said first position to said second position and for causing said ring member to rotate independently of said pivot pin, said pivot pin remaining substantially immobile, while said handle is moved from said second position to said first position.

15. The machine as set forth in claim 14 wherein said automatic indexing means further comprises means for assisting the rotation of said pivot pin towards the end of the movement of said handle from said first position to said second position.

16. The machine as set forth in claim 15 wherein said rotation assisting means also includes means for stopping the rotation of said pivot pin when said open end of one of said tubular members is adjacent said ram means.

17. The machine as set forth in claim 16, wherein said rotation assisting means comprises an indexing cam means having cam faces rotatable with said indexing head, a pivotally mounted alignment arm and a spring-loaded means for urging said alignment arm into constant contact with said cam faces of said indexing cam means.

18. The machine as set forth in claim 12, wherein said ejecting means further comprises means longitudinally positioned within said tubular members for depriming said one of said shell casing adjacent said head of said ram means while said lever is being moved from said second position to said first position.

19. The machine as set forth in claim 18, wherein said head of said ram means includes bore means formed therein for receiving the primers from said one of said shell casings.

20. The machine as set forth in claim 2, wherein each of said tubular members includes means for resizing the diameter of the brass body portions of said shell casings, means for resizing the diameter of the rim portions of said shell casings, and further means for reshaping the rim portions of said shell casings.

* * * * *